United States Patent [19]

Roosdrop

[11] Patent Number: 4,650,273

[45] Date of Patent: Mar. 17, 1987

[54] ELECTRICAL WEDGE CONNECTOR

[75] Inventor: Joannes W. M. Roosdrop, Braganca Paulista-SP, Brazil

[73] Assignee: AMP Incorporated, Harrisburg, Pa.

[21] Appl. No.: 798,342

[22] Filed: Nov. 6, 1985

Related U.S. Application Data

[63] Continuation of Ser. No. 660,754, Nov. 30, 1984, abandoned, which is a continuation of Ser. No. 488,969, Apr. 27, 1983, abandoned.

[51] Int. Cl.[4] ..... H01R 4/50

[52] U.S. Cl. ..... 339/247; 339/273 F

[58] Field of Search ..... 339/236, 240, 243, 247, 339/248 S, 252 R, 270 R, 273 R, 273 F

[56] References Cited

U.S. PATENT DOCUMENTS

| | | | |
|---|---|---|---|
| 2,814,025 | 11/1957 | Wade et al. | 339/256 SP |
| 2,828,147 | 3/1958 | Peiffer | 339/273 R |
| 3,275,974 | 9/1966 | Mixon, Jr. | 339/243 |
| 3,329,928 | 7/1967 | Broske | 339/247 |
| 3,349,167 | 10/1967 | Mixon, Jr. et al. | 174/94 |
| 3,588,791 | 6/1971 | Polidori | 339/247 |
| 3,920,310 | 11/1975 | Walsh et al. | 339/256 SP |

*Primary Examiner*—Gil Weidenfeld
*Assistant Examiner*—Gary F. Paumen
*Attorney, Agent, or Firm*—Allan B. Osborne

[57] ABSTRACT

An electrical wedge connector comprises a resilient wedge (2) folded up from sheet metal with an arcuate central web (10) having edge portions folded back in opposite sense to present sides (6), ends (11,12) being folded inwardly to the convex side of the web (10). The receptable 1 is of generally c-form having resilient bight portions (3) for receiving the wedge between them. Inturned flanges (5) on the receptacle serve as a stop to wedge insertion and a latch (7) on the wedge secures it to the receptacle against withdrawal.

7 Claims, 2 Drawing Figures

ELECTRICAL WEDGE CONNECTOR

This application is a continuation of application Ser. No. 660,754, filed Nov. 30, 1984, now abandoned, which is a continuation of application Ser. No. 488,969, filed Apr. 27, 1983, now abandoned.

This invention relates to an electrical wedge connector of the kind comprising a wedge receivable in a wedge shaped receptacle of generally C-shaped cross-section and adapted to secure conductor wires between sides of the wedge and bights of the receptacle.

Such connectors are commonly used for forming tap connections to overhead power conductors and generally require the wedge and receptacle to be matched to the conductor diameters to ensure secure mechanical and electrical connection. As a result, in environments where a wide variety of conductor sizes is used, a corresponding range of connectors is required. This is costly and also prevents a practical problem for line-men operating on overhead cables and needing access to a range of connectors of different conductor capacities.

In an electrical wedge connector according to the present invention, the wedge is formed from sheet metal to define a central web of arcuate form in cross-section, with edge portions of the web folded back in opposite sense to the arcuate section to present opposite sides to the wedge, and then folded inwardly towards the convex side of the arcuate wedge section.

As a result the wedge is resiliently compressible between the opposite sides, and on being driven into the wedge receptacle may be compressed to accommodate a wide range of conductor sizes.

Suitably the receptacle is also folded from sheet metal to provide resilient bight portions at opposite sides and which are capable of resilient outward flexure on insertion of the wedge.

The receptacle is suitably formed at a narrow end with an in-turned flange arranged to provide a stop limiting insertion of the wedge.

The wedge is suitably formed at its leading end with a forwardly extending tab turned back at its tip to present a rear facing shoulder adapted to engage an end surface of the receptacle in a snap fit, on full insertion of the wedge, in order to resist inadvertant withdrawal of the wedge from the receptacle.

The wedge and receptacle are suitably stamped and formed from sheet brass, but one or other of the members may be of material having stronger spring characteristics e.g. steel.

In use the connector is suitably coated with grease adapted to inhibit surface oxidisation.

Figure 1:
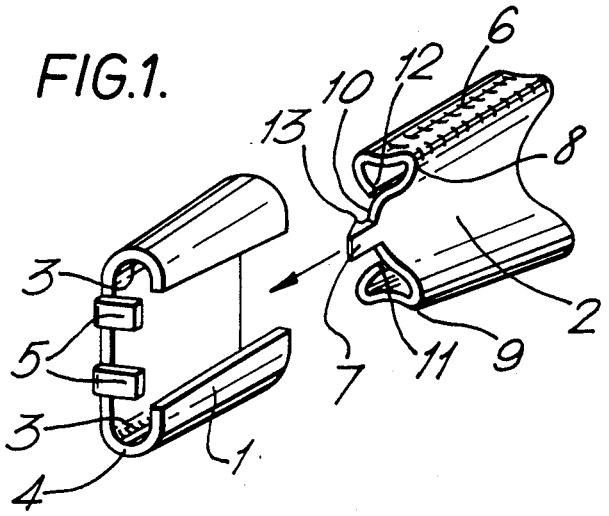
Figure 2:
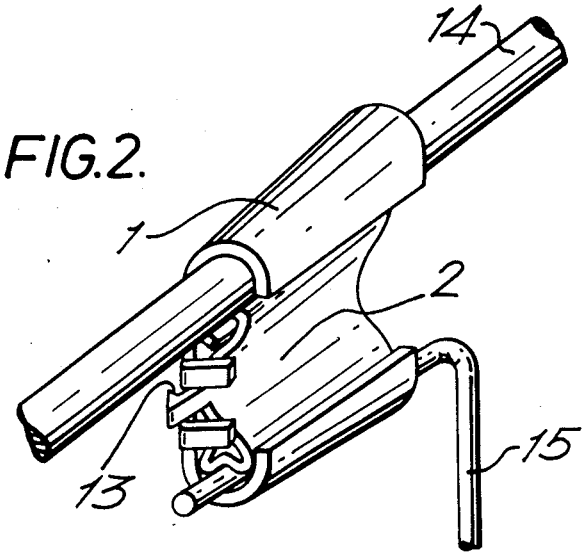

The invention will now be described by way of example with reference to the accompanying partly diagrammatic drawings, in which:

FIG. 1 is an exploded view of an electrical wedge connector according to the invention, and FIG. 2 is an assembled view of the connector of FIG. 1 connecting a small size tap conductor to a large size power conductor.

The wedge connector of FIGS. 1 and 2 comprises a receptacle 1 of generally C-shaped cross-section and tapering from right to left as seen in the figures from a wide end to a narrower end, and a wedge 2 tapering in similar manner and adapted to be telescopically received into the receptacle 1. The receptacle 1 is stamped and formed from sheet metal, suitably brass and has a pair of opposed bight portions 3 serrated transversely on their facing surfaces for improved engagement with the conductors to be connected. The bight 3 at the lower side is formed internally with a groove 4 extending longitudinally of the receptacle. At the left hand, narrower end, the receptacle 1 is formed with a pair of tabs 5 turned-in partially to close the opening at that end of the receptacle and serving to limit insertion of the wedge 2 through the receptacle 1.

The wedge 2 is stamped and formed from sheet metal, suitably brass, and has a central web 10, extending longitudinally, and of arcuate transverse cross-section. Upper and lower sides of the web 10 are turned back to present upper and lower sides 6 which converge from right to left and are formed with outwardly facing transversely concave surfaces. End portions 11, 12 of the turned back sides are then turned in towards the convex side of the web 10 at locations spaced apart. The upper and lower sides 6 are transversely serrated on the outer surfaces.

The wedge 2 at its leading narrower end is formed centrally with a tab 7 extending forwardly from the web 10 and with its free end bent back away from the concave side of the web 10 to present a rear facing shoulder 13.

In use, as shown in FIG. 2, a large power conductor 14 is positioned in the upper bight 3 of the receptacle, to extend longitudinally, whilst a smaller conductor 15 is positioned in the slot 4 of the lower bight, the slot 4 serving to stabilise the conductor in position. The wedge 2 is driven into the receptacle 1, between the conductors 14, 15 and the resultant wedge action develops transverse forces which tend to flex the receptacle bights 3 apart, and compress the upper and lower sides 6 of the wedge together by resilient flexure of the sheet metal. The wedge 2 is driven into the receptacle until it abuts the flanges 5, which serve as a stop, and the rear facing shoulder 13 engages beyond the forward end of the receptacle in a snap fit to resist withdrawal of the wedge.

The serrations in the receptacle 1 and wedge 2 which are at the contact faces with the conductors 14, 15 serve to abrade the conductors and break up oxide film in order to improve connection. The end portions 11, 12 of the wedge engage the convex side of the web 10 to resist inward movement and protect against overstressing of the wedge spring-form at the folds 8, 9.

Suitably the connection of FIG. 2 is coated with a grease-inhibitor to resist oxidisation in service.

The flexible nature of the wedge and receptacle allows accommodation of a wide range of wire combinations and also ensures a resilient contact force on the conductors due to the flexure of the receptacle and wedge on assembly.

What is claimed is:

1. An electrical connector for connecting electrical conductors together, comprising:

wedge-shaped receptacle means having a C-shaped cross section defining channel-shaped conductor receiving means along opposing longitudinal sides with each conductor receiving means facing the other; and wedge means, stamped and formed from flat sheet metal, having outwardly facing conductor engaging surfaces joined together by a single web extending therebetween, said web having an arcuate transverse cross section and said conductor engaging surfaces formed by folding longitudinal side edges back in towards said web, said wedge means slidably received in said receptacle means between and with said conductor engaging surfaces cooperating with said conductor receiving means to electrically engage and mechanically secure electrical conductors disposed therebetween.

2. The electrical connector of claim 1 wherein said central web is resilient so that said conductor engaging surfaces are compressible towards each other as said wedge means is received in said receptacle means with the conductors being in said conductor receiving means.

3. The electrical connector of claim 1 wherein said receptacle means is formed from a sheet metal blank and the channel-shaped conductor receiving means are resilient.

4. The electrical connector of claim 2 further including flange means at a narrow end of said receptacle means to limit the travel of said wedge means received therein.

5. The electrical connector of claim 2 further including transverse serrations on said conductor engaging surfaces and said conductor receiving means.

6. The electrical connector of claim 2 further including cooperating latch means on said receptacle means and said wedge means for latching the two together against separation.

7. The electrical connector of claim 6 wherein said latch means on said wedge means include a forwardly extending tab means having a rearwardly facing shoulder adapted to engage an end edge of said receptacle means.

* * * * *